US007963368B2

(12) United States Patent
Scudera et al.

(10) Patent No.: US 7,963,368 B2
(45) Date of Patent: Jun. 21, 2011

(54) SUSPENDED ANCHORED CLIMBING DEVICE WITH SAFETY FEATURES

(75) Inventors: Sam S. Scudera, Clayton, NY (US); Joseph F. Hasto, Williamstown, NY (US)

(73) Assignee: S & H Innovations LLC, Clayton, NY (US)

( * ) Notice: Subject to any disclaimer, the term of this patent is extended or adjusted under 35 U.S.C. 154(b) by 457 days.

(21) Appl. No.: 12/249,224

(22) Filed: Oct. 10, 2008

(65) Prior Publication Data

US 2010/0089700 A1 Apr. 15, 2010

(51) Int. Cl.
*E06C 7/16* (2006.01)

(52) U.S. Cl. ..... 182/116; 182/133; 182/206

(58) Field of Classification Search ..... 182/116, 182/133, 115, 136, 187, 206
See application file for complete search history.

(56) References Cited

U.S. PATENT DOCUMENTS

| | | | | | |
|---|---|---|---|---|---|
| 3,336,999 | A * | 8/1967 | McSwain | 182/20 |
| 3,995,714 | A * | 12/1976 | Brookes et al. | 182/100 |
| 4,090,587 | A * | 5/1978 | Pyle | 182/206 |
| 4,469,195 | A * | 9/1984 | Sartain | 182/206 |
| 4,484,660 | A * | 11/1984 | Baynum | 182/187 |
| 4,552,246 | A * | 11/1985 | Thomas | 182/116 |
| 4,747,468 | A * | 5/1988 | Greenway | 182/9 |
| 4,787,476 | A * | 11/1988 | Lee | 182/116 |
| 4,946,004 | A * | 8/1990 | Henson | 182/206 |
| 5,040,635 | A * | 8/1991 | Strickland | 182/100 |
| 5,141,074 | A * | 8/1992 | Sulowski et al. | 182/9 |
| 5,234,074 | A * | 8/1993 | Bell | 182/9 |
| 5,253,732 | A * | 10/1993 | Daniels | 182/116 |
| 5,275,257 | A * | 1/1994 | Robertson | 182/116 |
| 5,279,390 | A * | 1/1994 | Phillips | 182/187 |
| 5,311,967 | A * | 5/1994 | Kennedy | 182/133 |
| 5,332,063 | A * | 7/1994 | Amacker | 182/116 |
| 5,388,664 | A * | 2/1995 | Bator | 182/100 |
| 5,398,779 | A * | 3/1995 | Meyer | 182/187 |
| 5,590,738 | A * | 1/1997 | Hunt et al. | 182/116 |
| 5,655,623 | A * | 8/1997 | Skyba | 182/116 |
| 5,669,403 | A * | 9/1997 | Belcher et al. | 135/90 |
| 5,704,448 | A * | 1/1998 | Jenkins, Jr. | 182/93 |
| 6,427,803 | B1 | 8/2002 | Moore | |
| 6,516,918 | B2 * | 2/2003 | Hess | 182/20 |
| 6,715,585 | B1 * | 4/2004 | Overbaugh | 182/187 |
| 6,719,093 | B2 * | 4/2004 | Garbs | 182/116 |
| 6,725,970 | B2 * | 4/2004 | Garofalo | 182/115 |
| 6,811,180 | B1 * | 11/2004 | Molliere | 280/652 |
| 7,533,761 | B2 * | 5/2009 | Forrest | 182/136 |
| 7,717,232 | B2 * | 5/2010 | Butcher | 182/178.3 |
| 2001/0023794 | A1 * | 9/2001 | Andrey | 182/116 |
| 2003/0141146 | A1 * | 7/2003 | Skipper | 182/100 |
| 2004/0112676 | A1 * | 6/2004 | Skipper | 182/116 |
| 2007/0114096 | A1 * | 5/2007 | Skipper | 182/116 |
| 2008/0105490 | A1 * | 5/2008 | Butcher | 182/116 |
| 2008/0128204 | A1 * | 6/2008 | Engstrom | 182/116 |
| 2009/0223742 | A1 * | 9/2009 | LePage | 182/123 |
| 2010/0018803 | A1 * | 1/2010 | Schwenke et al. | 182/206 |
| 2010/0155176 | A1 * | 6/2010 | Lohr et al. | 182/113 |
| 2010/0213009 | A1 * | 8/2010 | Guinovart et al. | 182/206 |

* cited by examiner

*Primary Examiner* — Katherine Mitchell
*Assistant Examiner* — Johnnie A Shablack
(74) *Attorney, Agent, or Firm* — Bernhard P. Molldrem, Jr.

(57) ABSTRACT

A ladder or climbing device has hollow tubular jaws at its head end that permit a rope or cable to pass around the target tree or pole. A tubular cable guide is positioned along side the vertical rail for feeding the cable to the hollow jaws. The rail is formed of extension sections that are joined together. A security clamp or clasp attached over both the head of the device and the cable to secure to the worker's safety harness.

11 Claims, 5 Drawing Sheets

SUSPENDED ANCHORED CLIMBING DEVICE WITH SAFETY FEATURES

BACKGROUND OF THE INVENTION

This invention relates to portable climbing devices for use by individuals in climbing to an elevated position. The invention is more specifically concerned with a portable ladder the user secures to its target with a cable before climbing, including a built in fall protection harness hook, and a maximum and minimum angle indicator. The target can be a utility pole, a tree trunk, column, or other structure that is capable of being wrapped around by a rope or cable. The terms target and target pole are used here to cover any such item.

There are many known climbing and elevated support devices for elevating the position of a climber to a standing pole, tree, column, etc. Traditional ladders have been used by construction workers, hunters, naturalists, and homeowners. Traditional ladders are secured by leaning them up against the object to be climbed. The user has to climb the ladder to "test" the security. Even after the ladder is determined to be safe for climbing by the user, there is still a risk of an accidental fall due to the ladder not being completely secure. The Consumer Product Safety Commission reports that more than 90,000 individuals receive emergency room treatment for ladder accidents each year due to the fault of the user. In contrast, OSHA research has concluded that 100% of ladder accidents may be eliminated with proper attention to the application of the equipment, and the proper training of the climber. Human error causes most ladder falls, but most often the cause is administration of the equipment. This invention removes the risk of accidental falls due to improper securement to the desired object to be climbed.

At the present time, there is no means provided for securing the ladder at the top before climbing, or a means for securing the top of a ladder using a cable. Many persons are required for one reason or another to observe restrictions regarding the amount of weight he or she is allowed to carry, but there have not been suitable general purpose ladders available with the needed features of light weight construction, stability, and security of the type needed in a climbing device. Traditional ladders are unstable, and are subject to sway and tipping unless properly positioned and supported.

OBJECTS AND SUMMARY OF THE INVENTION

Accordingly, it is an object of this invention to provide a portable climbing device which is secured at the top using a cable which wraps around the desired object to be climbed and is secured before the user climbs the device, and which represents an advance over the prior art.

A further object is to provide a ladder or climbing device that can be secured at the top by a single user while he or she is working from the ground, and which permits the user to climb and work securely at the top of the device.

It is another object to provide a portable climbing device which has a built-in harness hook or loop to be used to secure the climber to the climbing device.

It is another object to provide a portable climbing device which can be configured in the field into shorter or taller versions by adding extensions.

A further object is to facilitate erection by use of a maximum/minimum angle indicator located at the base of the climbing device.

According to one aspect of this invention, an anchored climbing device can be removably attached at its top to a target pole, such as a utility pole, tree, column, or the like. The device has an elongated vertical rigid rail member with a base at its lower end for resting on the ground or on another horizontal ground support. There are pegs, rungs or other similar horizontal step members projecting at spaced intervals from the rail member. At the top of the rail member is affixed a head member, and the head member has left and right arcuate tubular jaw members pivotally supported on it. The head member also includes a mechanism for closing the jaw members around the target pole to form a tubular ring. The left and right tubular jaw members have elongated slots formed along their radially inward sides thereof to form a slot in the circumferential direction at the inner side of the tubular ring.

The rail member (or members) can be unitary or can come in multiple sections or extension members, between the base and the head. These can be of durable steel, aluminum, reinforced plastic, graphite, or fiberglass construction. The sections can snap together and be secured with a cotter pin or similar securement device.

A tubular cable guide extends vertically along the vertical rigid rail member, and this creates a channel which a rope or cable can be inserted and slid upwards.

A tubular connector at an upper end of the cable guide connects the cable guide with one of said left and right jaw members, to form a cable passage that extends through the rope guide, the connector, and the annular ring formed by the left and right jaw members. A cable exit portal is formed in the head to allow the cable to pass out of the other one of the left and right jaw members and to descend towards said base, where the rope or cable can be pulled tight by the user on the ground.

To erect the climbing device, the device is first positioned against the tree trunk or other target pole, and the left and right jaw members are closed together. Then the rope or cable is fed upwards through the cable guide, around said tubular ring, out said rope exit, and then back down to the base of the vertical rail member. The rope or cable is secured with a rope block at the lower entrance to the cable guide tube. Then, when tension is applied to the cable, the cable slips out through the slot in said tubular ring and snugs against said target pole to secure the upper end of the climbing device against the target pole. The free end of the rope or cable is secured to another rope block, which is strapped to an anchor point on the base. A ratchet device can be included to assist in pulling the cable tight.

To remove the climbing device, the rope blocks are removed from the rope or cable, and the cable is loosened, and then pulled free from the tree or other target pole. Then the climbing device can be easily removed from the target pole.

Preferably, the vertical rigid rail member is formed of a plurality of extension members, each having a male end and a female end to receive a male end of an adjacent one of said extension members. These can be connected, end to end, to create a climbing device or ladder that is the appropriate height for the particular target. In that case, the cable guide tube is formed of a plurality of tubular sections, each being attached to a respective one of the extension members. These also can have male and female ends, i.e., a plug end and a socket end, so that the cable guide tube will be properly created when the extension members are joined together.

The base can have a forked pair of downward extending projections that penetrate the earth and create a stable lower anchor point.

In a preferred embodiment the jaw members are constructed so that one of them has a female receptacle portion at its free end, and the other jaw members has a male portion at its free end that fits into said female receptacle portion when the jaw members are closed together. The cable slot extends along the female receptacle portion and also along the male portion, so that the cable slot is a continuous slot extending substantially the combined length of the left and right jaw members.

The means for closing the two jaw members can be a pair of arms that encounter the bole of the tree or other target pole when the climbing device or ladder is erected, and swing the jaws together to form the closed loop or ring.

In the preferred embodiment, there is a single vertical rail member, and the step members include a plurality of climbing pegs extending laterally from the sides of said vertical rail member. However, other embodiments can be in the form of a traditional ladder of two parallel rails with the step members being in the form or rungs.

In the preferred embodiment, the head member includes a horizontal work platform, and also includes an attachment device, such as a clamp, for attaching a safety harness to the head member.

With the device as shown and described, the device is easily erected and secured to the target pole. Then after securement, the ladder is in essence "suspended" by the cable and cannot detach from the tree, pole, etc. The weight of the climber secures the ladder to the ground. In addition, there is a built in means for securing a harness to the ladder itself. Another unique feature of this invention is a maximum/minimum angle indicator located at the base of the climbing device, so that the ladder can be checked to ensure it is at an angle that is in the safe range.

This invention is easy to use, lightweight for portability, and inexpensive to produce. This invention was inspired by one of the inventors, an avid hunter, having hip replacement surgery, which resulted in his being limited in how much weight he was permitted to carry. This invention is designed to be secure and easy to climb, even for partially disabled persons. The field of utilization for this climbing device is extensive and may be useful to homeowners, construction workers, hunters, landscapers, orchard workers, naturalists, DEC officials, firemen, and military personnel. According to the New York State Department of Environmental Conservation (DEC), there are an estimated 10.7 million hunters, who could use a device such as this as a safe and easily erected tree stand. The hunting community in the U.S. spends about $29.2 billion in hunting equipment. Renewed interest in hunting on state-owned land is made possible because the climbing device will not harm trees. The head portion of the device has rubber grippers to cushion the tree when the cable is tightened. Traditional methods involve the use of spiked climbing shoes and other methods which cause damage to trees. Many traditional tree stands require driving spikes into the tree, and the resulting damage to the trees would make it inappropriate to use in state forests. The climbing device of this invention avoids that problem.

The device can be made to match the environment of the climbing device, i.e., camouflage for hunting, fluorescent orange for construction work, etc.

Many other modifications and variations are possible which would not depart from the scope and spirit of this invention, as defined in the appended claims.

DETAILED DESCRIPTION OF A PREFERRED EMBODIMENT

Figure 1:
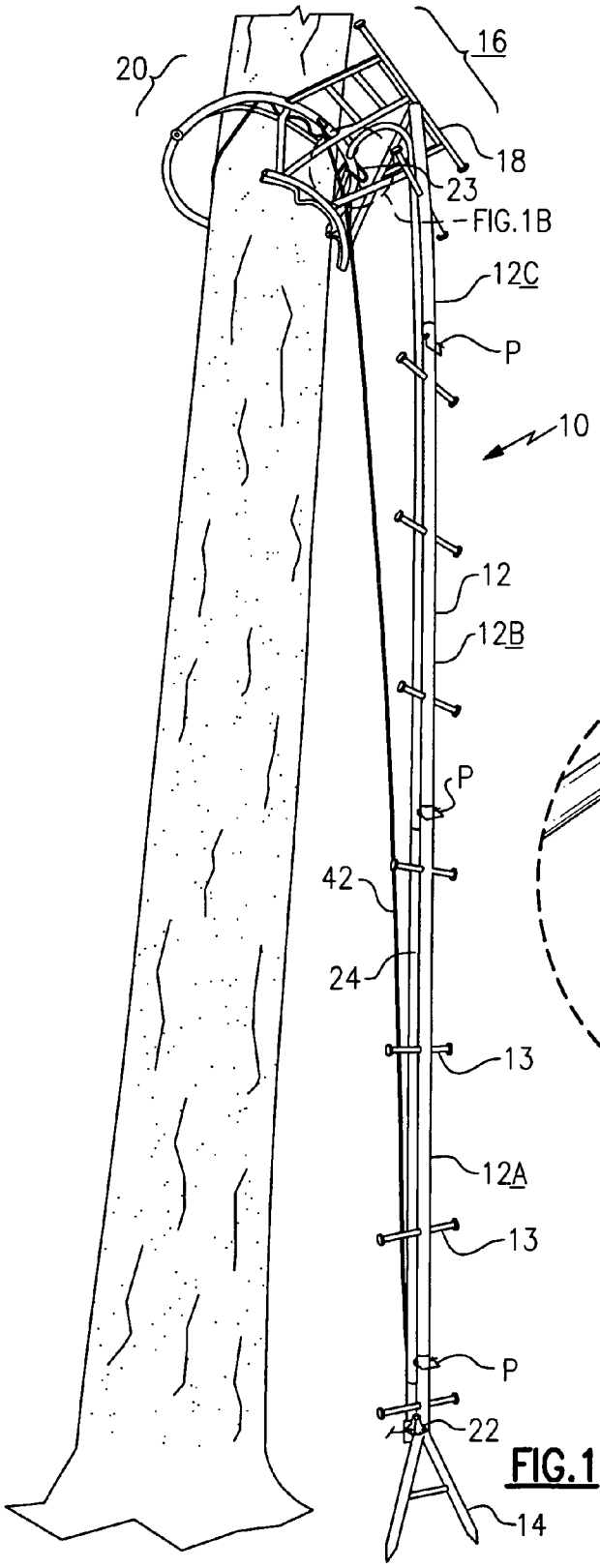
FIG. 1 is a perspective view of the climbing device according to one preferred embodiment of this invention.

With reference to the Drawing figures, and initially to FIG. 1, a tree climbing device or pole climbing device 10 is shown positioned against a vertical target T, which may be a tree, utility pole, vertical column or other tall vertical member. The device 10 has a vertical rigid rail member 12 that extends vertically from a base 14 to a head 16. The vertical rail member 12 can favorably be formed as a number of sections or extensions, 12A, 12B, 12C that can be attached to one another to create a structure of the desired height. In this case, the rail extensions 12A, 12B, 12C have a male plug member at one end that fits into a female socket member at the mating end of the next extension. There may also be openings passing through the male and female members so that a security pin P or key can be passed through to secure the extensions together.

The base 14 can include a pair of forked legs, reinforced with a cross brace. The legs may have pointed ends to penetrate the soil and anchor the lower end of the climbing device. For working on concrete or pavement, shoes or covers may be placed over these points.

At the top of the rail member 12 is a head 16. In this embodiment, the head includes a work platform 18, as well as a jaw assembly 20 that is employed for passing a rope or cable around the target T as described below to secure the head 16 of the device to the target.

Figure 1A:
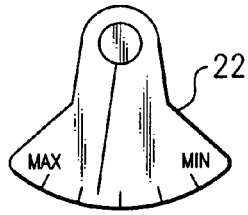
FIG. 1A is an enlargement of a portion of the device showing an angle or tilt indicator.
Figure 1B:
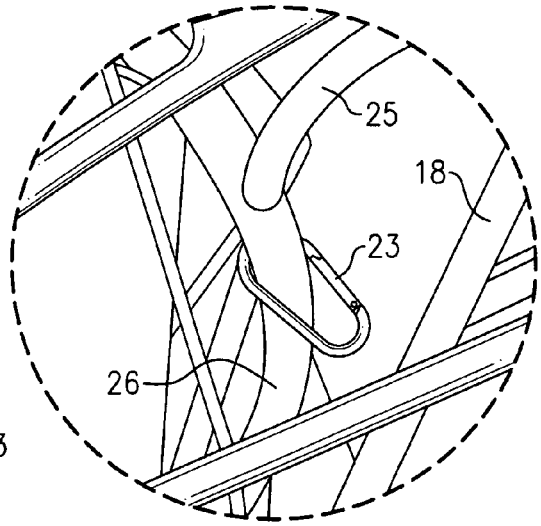
FIG. 1B is an enlargement of another portion of the device, showing a safety harness clip.

In this embodiment, there are a number of horizontal pegs 13 at spaced intervals along the rail member 12, that serve as steps for the user when climbing. At the base 14 is an angle gauge, i.e., maximum/minimum indicator 22, as shown in detail in FIG. 1A, for indicating minimum and maximum safe angles, for safe installation. At the head 16 is a clamp 23 (See FIG. 1B) for securing worker's safety harness to the platform 18 when the worker is elevated.

Figure 3:
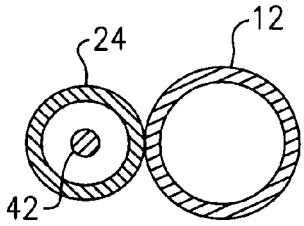
FIG. 3 is a cross section taken at line 3-3 of FIG. 2.

A cable guide tube 24 extends parallel to the rail member 12 and is joined to it, as shown in cross section in FIG. 3.

Figure 2:
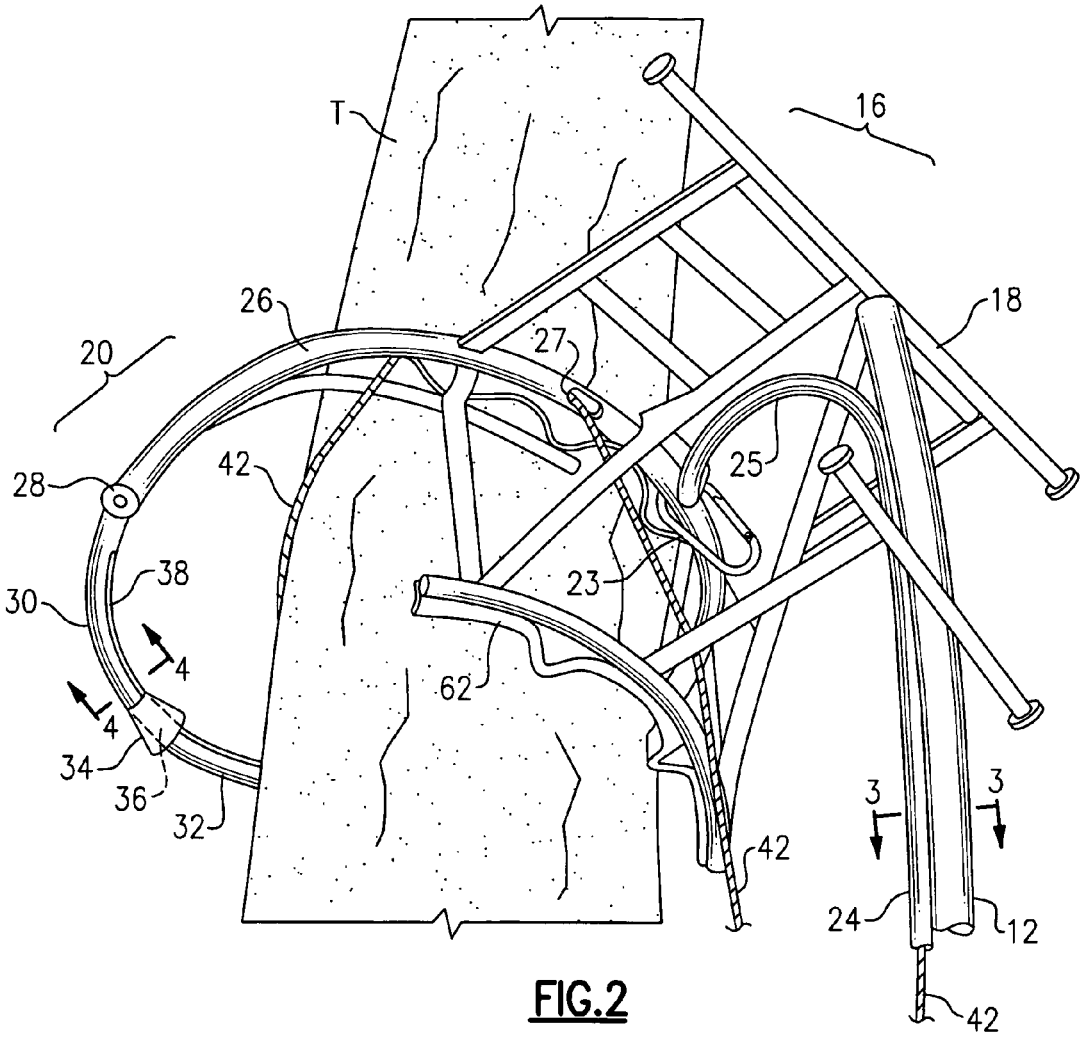
FIG. 2 is a perspective view of a head portion of the device of this embodiment.
Figure 4:
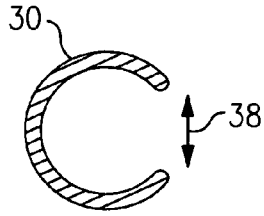
FIG. 4 is a cross section taken at line 4-4 of FIG. 2.
Figure 5:
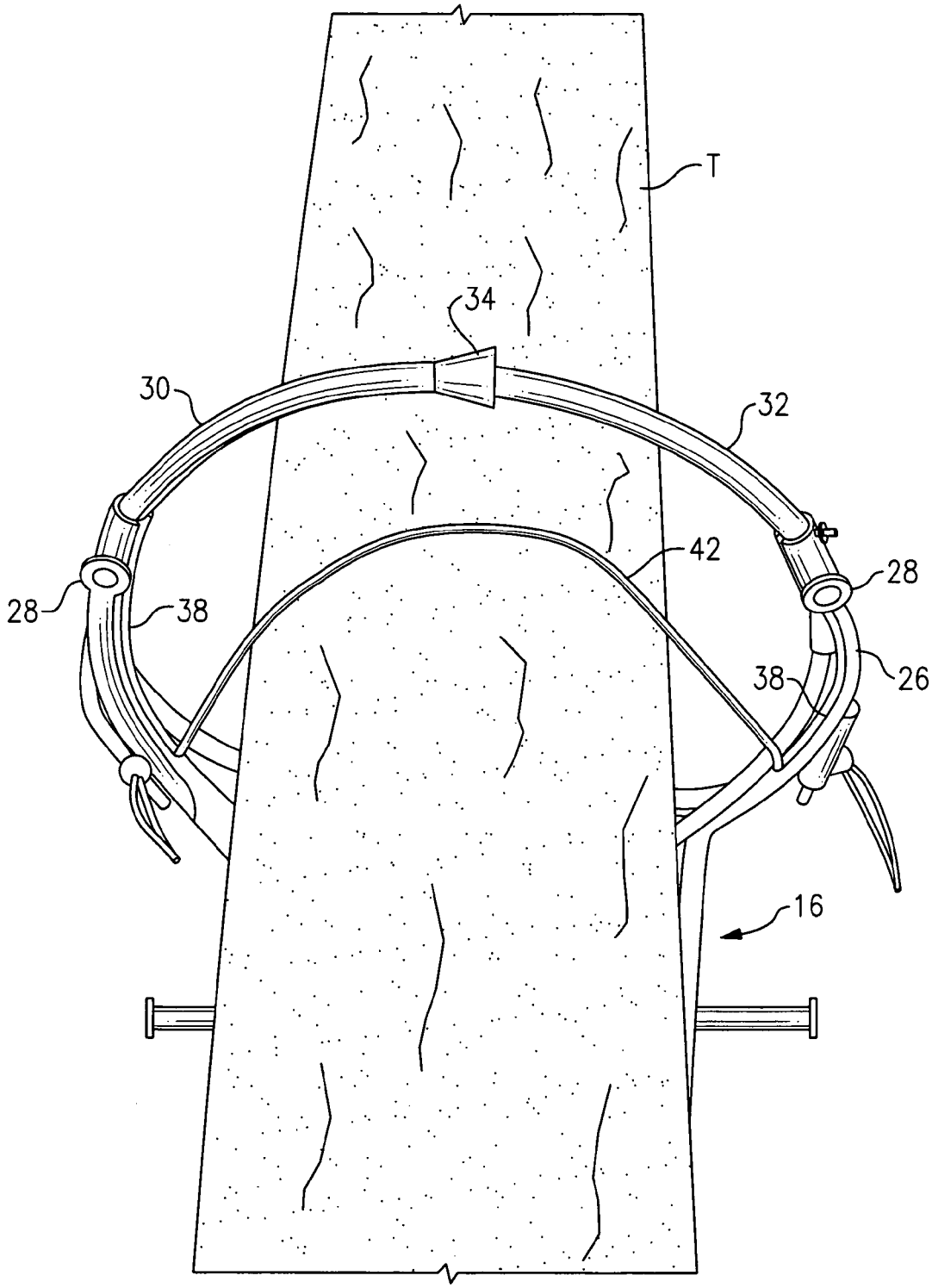
FIG. 5 is a perspective view of the head portion of this embodiment as viewed from a back side of the associated target pole.
Figure 7:
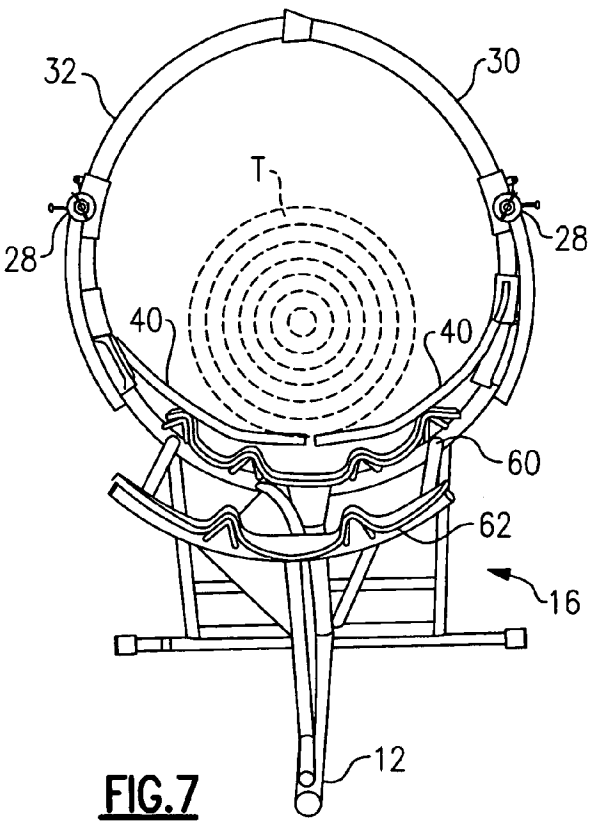
FIG. 7 is a plan view thereof showing the jaw members in a closed position.
Figure 6:
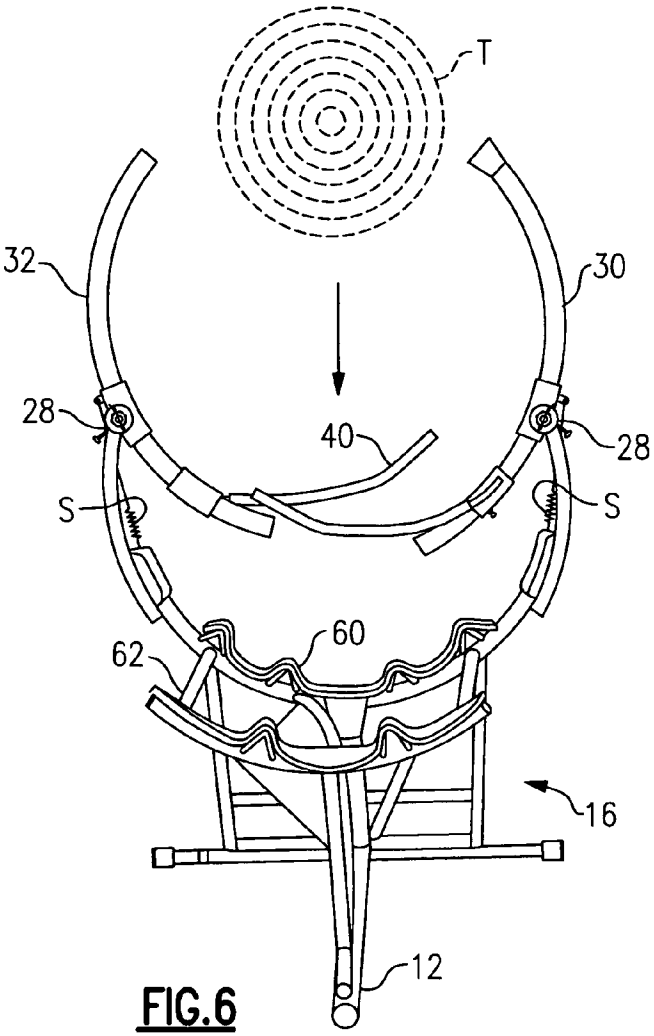
FIG. 6 is a plan view, from below, of the top of the device of this embodiment, showing the jaw members in an open position.

As seen in more detail in FIG. 2, and also in FIGS. 6 and 7, the jaw assembly 20 on the climbing device head 16 has a main support tube 26, generally semicircular in this embodiment, that is affixed to the head 16, and has pivot members 28 at each end. A left jaw member 30 is joined to one pivot member 28 and a right jaw member 32 is joined to the other. The support tube 28 and the left and right jaw members 30 and 32 form a hollow tubular ring, when the jaw members 30 and 32 are closed together. There is a female socket member 34 at the free end of the jaw member 30 and a male end 36 at the free end of the other jaw member 32. The socket member 34 acts as a receptacle to guide the free ends of the jaw members so that they close together when the climbing device is pushed against the target T. Preferably, the socket 34 is in the form of a rubber flange that guides the mating male end 36 to the center point so that the jaw members line up to pass the rope or cable. There is a slot 38 that extends along the radially inward side of the jaw members 30 and 32 and partway back along each side of the support tube 26. This slot is intended to permit a rope or cable to slip through and snugged against the target T, as will be discussed below. A cross section of the jaw member 30 showing the position of the slot 38 is illustrated in FIG. 4.

As is also shown in FIG. 2, an arcuate connector tube 25 joins the upper end of the cable guide tube 24 to the arcuate support tube 26.

There are contact arms 40 disposed on the head 16 at the proximal side of the tree or other target T, and these are attached at the pivot members 28 to the left and right jaw members 30 and 32, respectively. These contact arms 40 swing the jaw members to the closed position when the head 16 is pushed against the target, as illustrated in FIGS. 6 and 7. Favorably, spring members S, S may be employed, as shown in FIG. 6, to pull the jaw members 30 and 32 to their open position when the head 16 is away from the target T.

As also shown in FIGS. 6 and 7, there are upper and lower braces 60 and 62 formed as part of the head 16 and facing the tree or other target T, to help provide grip when the climbing device is secured against the target T. These have rubber cushions to contact the tree both for improved gripping and to keep the device from injuring the tree.

The climbing device 10 is secured to the pole, tree or other target T in the following manner: After the extensions 12A, 12B, 12C are assembled to the base 14 and head 16 so that the device 10 has the desired height, and the sections are held together by pushing a clasp through aligned holes where the male and female ends meet. The climbing device 10 is erected so that the head 16 goes against the target T. The base is moved to a position at which the gauge 22 indicates that the angle from vertical is within safe limits. The contact with the target T swings the jaw members 30 and 32 to their closed position, as shown in FIG. 7. Then a stiff but pliable cable or rope 42 is inserted into the lower end of the guide tube 24 and is fed upwards. The cable or rope 42 passes through the connector tube 25 and into the ring formed by the support tube 26 and the tubular jaw members 30 and 32. The cable or rope follows the outside of the curve of this ring. There is a cable exit port 27 formed on the support member 26, and the rope or cable exits through this port 27. As the operator continues to feed the rope or cable 42 through the guide tube 24, the end of the cable that has exited the port 27 drops down alongside the vertical rail member 12. When the free end of the cable is at or near the base, the supply of cable 42 is secured to the lower end of the guide tube 24 and the other end can be pulled taut. This pulls the cable 42 tight within the jaw members 30 and 32, so the rope slips through the inward slot 38. The operator continues to pull the cable until the loop of cable or rope at the head is pulled snug against the pole or tree trunk.

Figure 8:
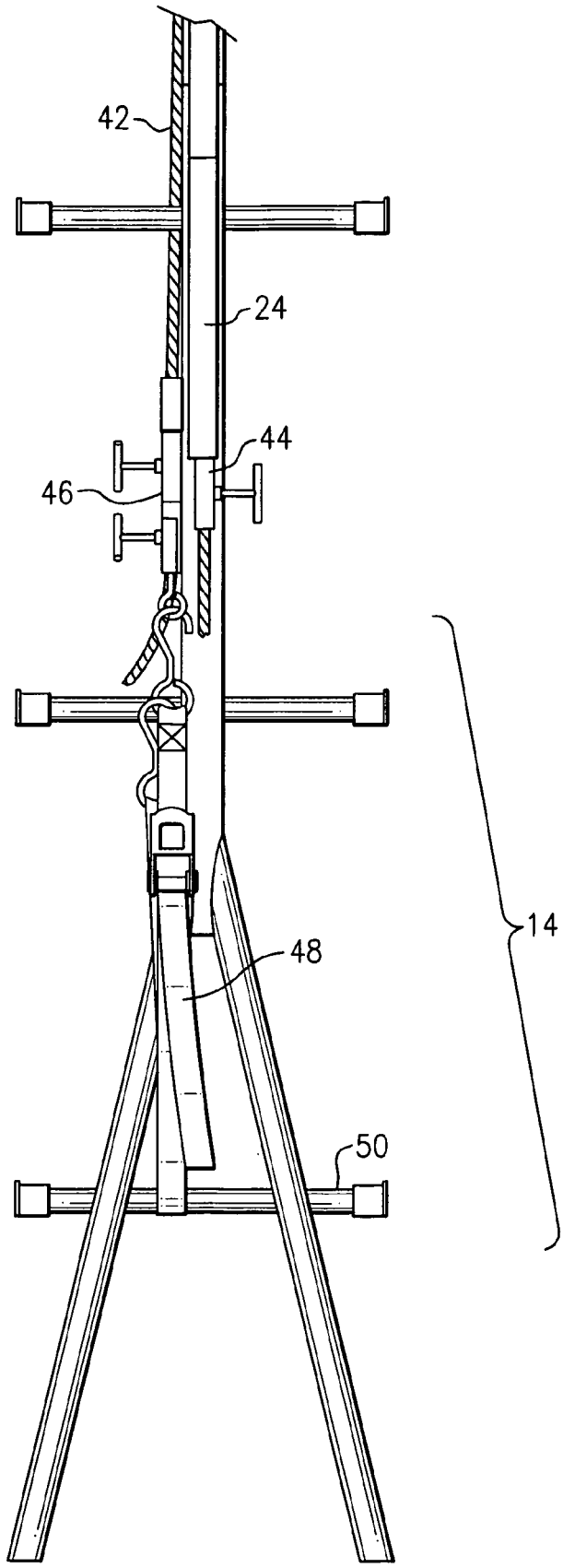
FIG. 8 is a perspective view of a base of the device of this embodiment.

As shown in FIG. 8 a cable block 44 can be secured to the supply portion of the rope or cable 42 to block if from being pulled up through the guide tube 24. Another cable block 46 is installed on the free end of the rope or cable, and this block can be secured by means of a strap 48 to a cross-bar 50 of the base 14. The cable blocks 44, 46 may be secured to the cable by use of thumb screws. A ratchet clamp may be used to snug the cable. The operator then climbs up the first set of pegs or rungs, and checks for sway and rotation of the device 10. If need be, the cable can be ratcheted again. Then the operator can climb to the top and secure his or her work harness to the clamp 23, and work securely at that elevation. Here, the clamp 23 is secured to the jaw main support tube 26, which contains the cable 42 within it, so that the harness is secured not only to the head 16 but also to the cable 42.

To remove the climbing device from the target tree or pole, the above steps are reversed. The operator removes the cable blocks 44, 46 and relieves the tension on the cable 42. The cable is withdrawn from the cable guide tube 24, and the device is pulled away from the target T and lowered. The climbing device can be disassembled, or can be positioned against another target.

In this embodiment, there is a single rail member 12 formed in sections or extensions, and the cable guide tube 24 is likewise formed of a series of sections. The rail member is formed as a round tubular aluminum extrusion. However, in other embodiments, other rail construction could be used. There may be a pair of rail members, with the steps being in the form of rungs that join the two rail members. The rail may have square or oblong section. For electrical work, the rail member or members may be formed of a non-conductive material, such as fiberglass.

The work platform 18 can take on any of a variety of forms, depending on the desired application. The platform 18 can incorporate a seat, if used as a hunting stand, or may incorporate a tool tray or tool box.

Other modifications and variations are possible, without departing from the scope of this invention, as defined in the claims.

We claim:

1. Anchored climbing device for removably attaching to a target pole, comprising:

an elongated vertical rigid rail member having a base at a lower end thereof for resting on a horizontal ground support;

a plurality of horizontal step members projecting at spaced intervals from said rail member;

a head member affixed at a top end of said rail member, the head member including left and right arcuate tubular jaw members pivotally supported on said head member, including means for closing said jaw members around said target pole to form a tubular ring, said left and right tubular jaw members having elongated slots formed along radially inward surfaces thereof to form a slot at the inner side of said tubular ring;

a tubular cable guide extending vertically along said vertical rigid rail member, through which a cable can be inserted and slid upwards;

a tubular connector at an upper end of the cable guide for connecting the cable guide with one of said left and right jaw members, to form a cable passage that extends through the cable guide, the connector, and the tubular ring formed by said left and right jaw members;

a cable exit for allowing the cable to pass out of the other of the left and right jaw members and to descend towards said base;

wherein with the device positioned against the target pole and with the left and right jaw members closed together, the cable can be fed upwards through the cable guide, around said tubular ring, out said cable exit, and then back down to the base of said vertical rail member; such that when tension is then applied to the cable, the cable slips out through the slot in said tubular ring and snugs against said target pole to secure the upper end of the climbing device against the target pole.

2. The climbing device according to claim 1 wherein said vertical rigid rail member is formed of a plurality of extension members, each having a male end and a female end to receive a male end of an adjacent one of said extension members.

3. The climbing device according to claim 2 wherein said cable guide tube is formed of a plurality of tubular sections, each being attached to a respective one of said extension members.

4. The climbing device according to claim 1 wherein said base includes a forked pair of downward extending legs.

5. The climbing device according to claim 1 wherein one of said jaw members has a female receptacle portion at a free end thereof, and the other of the jaw members has a male portion at its free end that fits into said female receptacle portion when the jaw members are closed together.

6. The climbing device according to claim 5 wherein said slot extends along said female receptacle portion and across said male portion to form a continuous slot extending substantially the combined length of the left and right jaw members.

7. The climbing device according to claim 1 wherein said step members include a plurality of climbing pegs extending laterally from the sides of said vertical rail member.

8. The climbing device according to claim 1 wherein said head member includes a horizontal work platform.

9. The climbing device according to claim 1 wherein said head member includes an attachment device for attaching a safety harness to the head member.

10. The climbing device according to claim 1 wherein said attachment device is secured on a portion of said head member and also to said cable.

11. The climbing device according to claim 1 further comprising one or more rubber cushions disposed at said head opposite said jaw members for contacting and gripping said target pole.

* * * * *